US007717750B1

(12) United States Patent
Layer

(10) Patent No.: US 7,717,750 B1
(45) Date of Patent: May 18, 2010

(54) KIT FOR CONVERTING N CLASS BUS PLUG TO A J CLASS BUS PLUG

(75) Inventor: Jeffrey W. Layer, Howell, MI (US)

(73) Assignee: Bulldog Sales Company Inc., Howell, MI (US)

( * ) Notice: Subject to any disclaimer, the term of this patent is extended or adjusted under 35 U.S.C. 154(b) by 0 days.

(21) Appl. No.: 12/436,363

(22) Filed: May 6, 2009

(51) Int. Cl.
*H01R 13/68* (2006.01)

(52) U.S. Cl. ..... 439/620.26

(58) Field of Classification Search ..... 439/620.26, 439/620.27, 620.28, 620.29, 806, 698; 337/177; 218/12
See application file for complete search history.

(56) References Cited

U.S. PATENT DOCUMENTS 2,355,085 A * 8/1944 Landmeler ..... 439/806
6,146,206 A * 11/2000 Konno et al. ..... 439/620.26
6,162,097 A * 12/2000 Liang ..... 439/620.27
6,585,541 B2 * 7/2003 Higashida et al. ..... 439/620.27

* cited by examiner

*Primary Examiner*—Chandrika Prasad
(74) *Attorney, Agent, or Firm*—Gifford, Krass, Sprinkle, Anderson & Citkowski, P.C.

(57) ABSTRACT

A kit for converting an N class bus plug to a J class bus plug in which the N class bus plug has three pairs of spaced apart fuse terminals. A Z-shaped conductive strip is associated with each fuse terminal and each conductive strip has a top and a bottom. A first fastener secures the bottom of the conductive strip to its associated fuse terminal. A J class fuse is then associated with each pair of fuse terminals. The J class fuse has a flat conductive electrical contact extending outwardly from each end which overlies the top of one of the conductive strips. A second fastener then connects the electrical contact with the top of its associated conductive strip.

5 Claims, 2 Drawing Sheets

KIT FOR CONVERTING N CLASS BUS PLUG TO A J CLASS BUS PLUG

BACKGROUND OF THE INVENTION

I. Field of the Invention

The present invention relates generally to bus plugs.

II. Description of Related Art

Modern day factories are typically equipped with electrical bus for supplying three phase electrical power to the machinery in the factory. The electrical bus typically includes three main conductors and occasionally has a neutral phase and an integral ground bar. The supply voltage may be either 240 or with 600 volts being the maximum rating.

In order to electrically connect the electrical bus with the machinery, conventionally a bus plug is attached to the preexisting ports along a length of bus. The bus plug contains three fuses, one for each phase bar of the electrical bus. Consequently, once the bus plug is attached to the electrical bus, one end of each of the electrical fuses is electrically connected to the electrical bus (line side). The other ends of the fuses (load side) are then connected to the machinery which is powered through the electrical bus plug.

Electrical equipment of the type used in factories is typically powered by either 240 or 480 volts. Conventionally, an N class bus plug is employed with a 240 volt electrical bus and N class fuses are conventionally used with the N class bus plug. Such N class fuses are rated to operate at 240 volts.

Conversely, an R class bus plug is conventionally employed with electrical buses maintained at 480 volts. Such R class bus plugs accept R class fuses which are rated at 600 volts maximum. Such R class fuses are significantly longer than the N class fuses utilized in the 240 volt bus plug.

Since the R class fuses for 600 volts are longer in size than the N class fuses for 240 volts, the housing for an R class bus plug is also longer in size than the N class bus plug. This, in turn, increases the overall cost of an R class bus plug. Furthermore, R class bus plugs are much rarer than the N class bus plugs and thus more costly to obtain for the reconditioning and refurbishing business for such bus plugs.

There is a J class fuse which is essentially the same in size as the N class fuse, but the J class fuse is rated up to 600 volts. It is not possible, however, to simply replace the N class fuse in an N class bus plug with a J class fuse since the J class fuse uses a different electrical connection than the N class fuse. Consequently, where a 600 volt bus plug has been required, it has been necessary previously to use the larger size and more expensive R class bus plug with its larger housing.

SUMMARY OF THE PRESENT INVENTION

The present invention overcomes the above-mentioned disadvantages of the previously known bus plugs by providing a kit to convert an N class bus plug to accept J class fuses. As such, the kit of the present invention allows a relatively inexpensive 240 volt N class bus plug to be converted inexpensively to a 600 volt bus plug while maintaining nationally recognized safety standards.

In brief, the kit of the present invention comprises a plurality of Z-shaped electrical conductive strips which are preferably made of copper or a copper alloy. One Z-shaped conductive strip is associated with each fuse terminal in the N class bus plug.

A first fastener is associated with each strip. This first fastener secures the bottom of the conductive strip to its associated fuse terminal.

Thereafter, a J class fuse is associated with each pair of fuse terminals. The J class fuse includes a flat conductive electrical contact extending outwardly from each end. One electrical contact from the J class fuse overlies and flatly abuts against the top of one of the conductive strips.

Thereafter, a second fastener electrically connects each electrical contact of the class fuse with the top of its associated conductive strip. This second fastener preferably comprises a bolt and nut.

A third fastener, solder, is applied with heat to solidify the connection of the Z bracket to the copper conductors in the existing plug mechanism.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
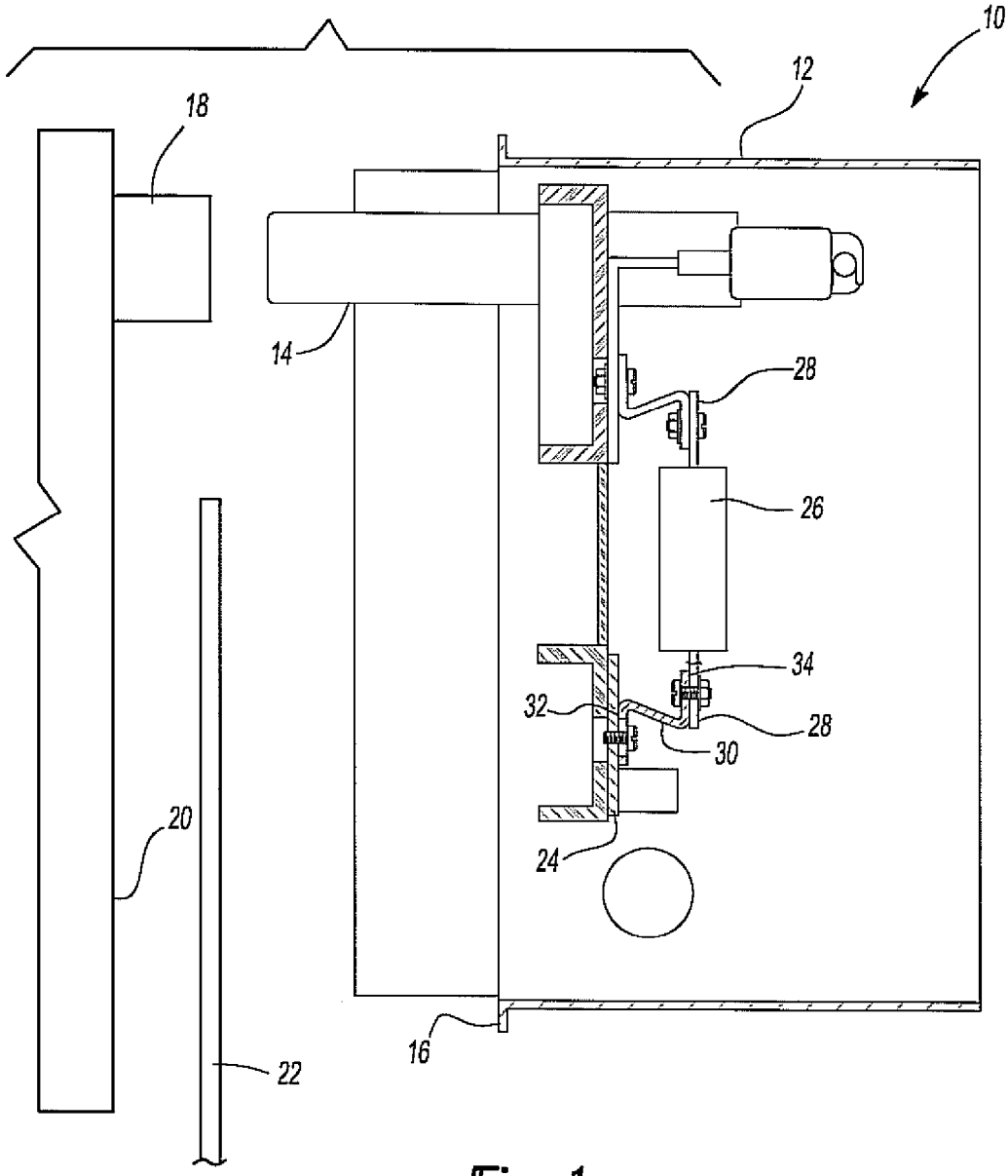
FIG. 1 is a sectional view taken substantially along line 1-1 in FIG. 2.
Figure 2:
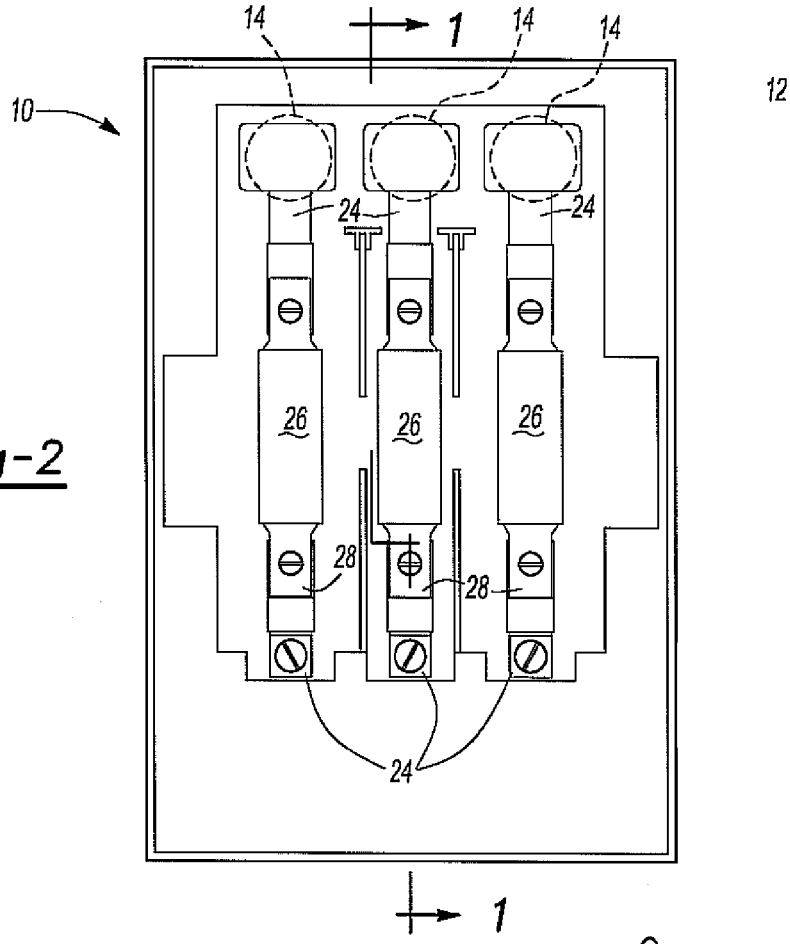
FIG. 2 is a plan view of an N class bus plug converted to 600 volt operation utilizing the kit of the present invention.

With reference first to FIGS. 1 and 2, a bus plug 10 is shown having an N class housing 12. The housing 12 also includes a cover which has been removed in the drawing for clarity.

The bus plug 10 includes three electrical connectors 14 which protrude outwardly from a back 16 of the housing 12. Each electrical connector 14 is adapted for connection with one line 18 (FIG. 1) of an electrical bus 20 of the type found in factories. Such electrical bus includes three separate lines, and together they supply three phase electrical power. The electrical bus 20 illustrated in FIG. 1 is rare at 600 volts maximum.

For safety, the electrical bus 20 is contained within and separated by insulators from the housing 22. The housing 22 includes access plates (not shown) which are removed to allow the electrical connectors 14 to engage the electrical contacts 18 of the electrical bus 20. The bus plug housing 12 is then secured to the bus housing 22 in any conventional fashion, such as by screws.

Still referring to FIGS. 1 and 2, the bus plug 10 includes three pairs of spaced apart fuse terminals 24 and one electrical fuse 26 is associated with each pair of electrical terminals 24. Consequently, as best shown in FIG. 2, the upper three fuse terminals 24 are electrically connected to the bus 14 while the lower three electrical terminals are adapted to be connected to the electrical powered machinery in the factory.

The fuses 26 illustrated in the patent drawing are J type fuses for a 600 volt application. Each J class fuse 26 includes a flat electrical contact 28 extending outwardly from each end of the fuse 26. However, these electrical contacts 28 are not compatible with and, therefore, cannot be used with a standard N class bus plug since the standard electrical terminals 24 in a standard N class bus plug are not dimensioned to receive the J class fuse 26.

Figure 3:
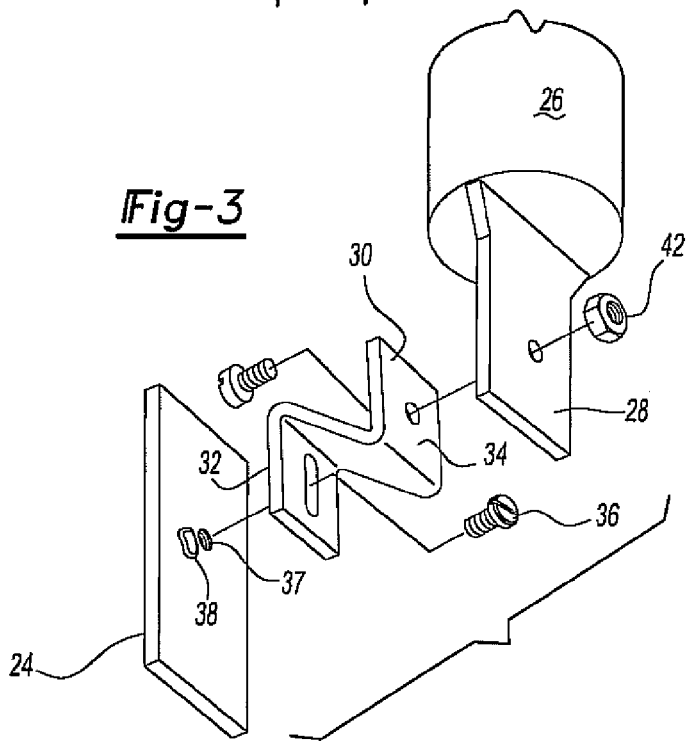
FIG. 3 is a fragmentary exploded elevational view illustrating a portion of the present invention.

Consequently, with reference to FIGS. 1 and 3, the present invention provides a conversion kit to convert a standard N class bus plug to accept J class fuses. In doing so, the standard N class bus plug and its housing may be used with a 600 volt electrical system.

With reference then to FIGS. 1 and 3, the kit of the present invention includes six Z-shaped conductive strips 30 which are made of an electrically conductive material and formed from flat metal bar stock. Each conductive strip 30 is preferably made of copper or a copper alloy and one conductive strip 30 is associated with each of the six fuse terminals 24.

Each Z-shaped conductive strip 30 includes a generally flat bottom 32 and a generally flat top 34. The flat bottom 32 is positioned flatly against its associated fuse terminal 24 and is secured to its associated fuse terminal 24 by a first fastener 36, such as a bolt which engages a threaded hole 37 in the terminal 24. In doing so, the Z-shaped conductive strip is electrically connected to its associated fuse terminal 24. However, to enhance the electrical connection between the Z-shaped conductive strip and its associated fuse terminal 24, the bottom 32 of the Z-shaped conductive strip 30 is also preferably soldered to its associated fuse terminal 24 by solder 38 (FIG. 3) after the Z-shaped strip 30 is bolted to the terminal 24.

After all six Z-shaped conductive strips have been attached to their associated fuse terminals 24, the J class fuses 26 are positioned within the fuse box housing 12 so that the flat electrical contacts 28 overlie and flatly abut against the top 34 of the Z-shaped conductive strips 30. The electrical contacts 28 of the fuses 26 are then secured to the top of their associated Z-shaped conductive strips 30 at each end of the fuse 26 by second fasteners 42, such as a nut and bolt, thus electrically connecting the fuse contacts 28 to their associated electric terminals 24 through the Z-shaped conductive strip 30. These second fasteners 34 are preferably a bolt and nut in which the bolt extends through registering holes in the fuse contact 28 and top 34 of the conductive strip 30.

As can be seen from the foregoing, the present invention enables a conventional N class bus plug with its conventional size housing 12 to be converted to a 600 volt bus plug using T class fuses 26. This results in substantial savings in the reconditioning/refurbishing business since housings 12 for N class bus plugs are not only more plentiful, but much less expensive, than the previously used R class bus plugs.

Having described my invention, many modifications thereto will become apparent to those skilled in the art to which it pertains without deviation from the spirit of the invention as defined by the scope of the appended claims.

I claim:

1. A kit for converting an N class bus plug to a 600 volt bus plug, said N class bus plug having three pairs of spaced apart fuse terminals, said kit comprising:

a Z-shaped conductive strip associated with each fuse terminal, each conductive strip having a top and a bottom, a first fastener associated with each conductive strip, said fastener securing said bottom of said conductive strip to its associated fuse terminal, a J class fuse having associated with each pair of fuse terminals, said J class fuse having a flat conductive electrical contact extending outwardly from each end so that each electrical contact overlies the top of one of said conductive strips, a second fastener which connects each electrical contact with said top of its associated conductive strip.

2. The invention as defined in claim 1 wherein each conductive strip is formed from flat bar stock comprising copper.

3. The invention as defined in claim 1 wherein said first fasteners comprise bolts.

4. The invention as defined in claim 1 wherein each said second fastener comprises a bolt and a nut.

5. The invention as defined in claim 1 and comprising solder disposed between said bottom of each conductive strip and its associated fuse terminal.

* * * * *